US008769859B2

(12) United States Patent
Li et al.

(10) Patent No.: US 8,769,859 B2
(45) Date of Patent: Jul. 8, 2014

(54) FIREARM SIGHT MOUNT

(75) Inventors: Daohai Li, Chengdu (CN); James Sellers, Mansfield, TX (US); Jonathan Horton, Mansfield, TX (US)

(73) Assignee: Sellmark Corporation, Mansfield, TX (US)

( * ) Notice: Subject to any disclaimer, the term of this patent is extended or adjusted under 35 U.S.C. 154(b) by 9 days.

(21) Appl. No.: 13/336,320

(22) Filed: Dec. 23, 2011

(65) Prior Publication Data

US 2013/0160345 A1 Jun. 27, 2013

(51) Int. Cl.
*F41G 1/38* (2006.01)
*F41G 11/00* (2006.01)

(52) U.S. Cl.
CPC ..... *F41G 11/001* (2013.01)
USPC ..... 42/124; 42/128

(58) Field of Classification Search
CPC ..... F41G 1/38; F41G 1/387; F41G 11/001; F41G 11/005; F41G 11/006; F41G 11/007; F41G 11/008
USPC ..... 42/124, 128, 125
See application file for complete search history.

(56) References Cited

U.S. PATENT DOCUMENTS 2,425,130 A * 8/1947 Shelley ..... 42/16
2,527,289 A * 10/1950 Allen ..... 42/128
2,529,801 A * 11/1950 Fisk ..... 42/128
2,629,175 A * 2/1953 Merritt ..... 42/128
2,639,507 A * 5/1953 Pachmayr ..... 42/128
2,644,237 A * 7/1953 Pachmayr ..... 42/128
2,710,453 A * 6/1955 Beverly ..... 42/128
2,803,880 A * 8/1957 Weaver ..... 42/128
3,178,823 A * 4/1965 Lipski ..... 42/126
3,226,868 A * 1/1966 Mahoney ..... 42/128
3,750,318 A 8/1973 Burris
4,092,793 A * 6/1978 Ricks ..... 42/128
4,461,087 A * 7/1984 Norman ..... 42/128
4,571,870 A 2/1986 Heideman et al.
5,111,587 A 5/1992 Plank
5,606,818 A 3/1997 Hardee
5,680,725 A * 10/1997 Bell ..... 42/127
6,442,883 B1 * 9/2002 Waterman et al. ..... 42/124
6,513,276 B2 2/2003 Mendoza-Orozco
6,629,381 B1 10/2003 Keng (Continued)

OTHER PUBLICATIONS

Notice of Allowance and Issue Fee Due PTO 892, Dec. 24, 2012, Design Patent Application 29/409496, Daohai Li, James Sellers, Jonathan Horton, filed Dec. 23, 2011.

*Primary Examiner* — Michelle Clement
(74) *Attorney, Agent, or Firm* — Mark D. Perdue

(57) ABSTRACT

A sight base is configured to receive and secure a sighting device and is coupled to a base by a pin running in each of the grooves and rotatable about the pins between an aligned position with the base extending between the parallel walls and the optical device aligned with the sighting axis, and a deployed position rotated away from the aligned position. A detent releasably retains the sight base in the aligned position. A clamp member is carried on the lower extent of the base, and releasably engages the rail with selectively movable to tighten and secure the clamp and base to the rail. A lever is coupled to the base and to the clamp member, and has a camming surface configured to move the movable portion of the clamp into and out of engagement with the rail in response to actuation of the lever. The camming surface of the lever bears on a resilient surface carried by the base.

14 Claims, 3 Drawing Sheets

(56) References Cited

U.S. PATENT DOCUMENTS

| | | | | |
|---|---|---|---|---|
| 6,637,144 | B2 * | 10/2003 | Nelson et al. | 42/120 |
| 6,922,934 | B1 * | 8/2005 | Huan | 42/127 |
| 6,931,778 | B1 * | 8/2005 | Nelson et al. | 42/120 |
| 7,065,916 | B2 * | 6/2006 | Ballard | 42/118 |
| 7,107,716 | B1 * | 9/2006 | Liao | 42/108 |
| 7,367,152 | B2 * | 5/2008 | Samson | 42/128 |
| 7,493,721 | B2 | 2/2009 | Swan | |
| 7,562,485 | B2 * | 7/2009 | Newhall et al. | 42/127 |
| 7,614,175 | B2 | 11/2009 | Davis et al. | |
| 7,685,759 | B2 * | 3/2010 | Teetzel | 42/127 |
| 7,730,655 | B2 * | 6/2010 | Spuhr | 42/127 |
| 7,757,423 | B1 * | 7/2010 | Swan | 42/127 |
| D623,254 | S | 9/2010 | Larsson | |
| 7,802,395 | B1 | 9/2010 | Swan | |
| 7,823,316 | B2 | 11/2010 | Storch et al. | |
| 7,908,782 | B1 * | 3/2011 | LaRue | 42/128 |
| 8,132,355 | B1 * | 3/2012 | Kincaid et al. | 42/124 |
| 8,171,666 | B2 | 5/2012 | Karagias | |
| 8,424,234 | B2 * | 4/2013 | Carlson et al. | 42/90 |
| D681,767 | S * | 5/2013 | Li et al. | D22/109 |
| 8,438,773 | B2 * | 5/2013 | Carlson et al. | 42/90 |
| 8,438,965 | B2 * | 5/2013 | Collin et al. | 89/125 |
| 8,484,882 | B2 * | 7/2013 | Haley et al. | 42/132 |
| 8,499,485 | B2 * | 8/2013 | Deros | 42/125 |
| 8,510,983 | B2 * | 8/2013 | Larue | 42/148 |
| 2004/0148842 | A1 | 8/2004 | Aalto et al. | |
| 2004/0244263 | A1 * | 12/2004 | Pettersson et al. | 42/128 |
| 2006/0117636 | A1 * | 6/2006 | Newhall et al. | 42/124 |
| 2006/0162227 | A1 * | 7/2006 | Samson | 42/148 |
| 2006/0207156 | A1 | 9/2006 | Larue | |
| 2008/0155876 | A1 * | 7/2008 | Matthews et al. | 42/124 |
| 2008/0168696 | A1 | 7/2008 | Orne et al. | |
| 2010/0107467 | A1 * | 5/2010 | Samson et al. | 42/127 |
| 2010/0229450 | A1 | 9/2010 | Becker | |
| 2011/0076095 | A1 * | 3/2011 | Storch et al. | 403/322.4 |
| 2011/0138673 | A1 | 6/2011 | Deros | |
| 2011/0296731 | A1 | 12/2011 | Carlson et al. | |
| 2011/0296732 | A1 * | 12/2011 | Carlson et al. | 42/90 |

* cited by examiner

FIREARM SIGHT MOUNT

BACKGROUND OF THE INVENTION

1. Field of the Invention

The present invention relates generally to mounting devices for firearm sights or sighting devices. More particularly, the present invention relates to such mounting devices having quick-detach and offset features that increase the versatility of the sight mounted using the device.

2. Summary of Prior Art

For decades various mounting devices have been used to mount telescopic sights to rifles. More recently, different types of sights, including "night-vision," laser, and holographic sights, have been mounted to a variety of firearms, including handguns and shotguns in addition to rifles. Some of the more modern sights are of limited or special purpose, such as night sights, so that their use is not optimal in all conditions and replacement or alternative sights are desirable.

In some cases, it may be advantageous to be able to offset or move a sight out of alignment or to an offset position whereby another sight mounted on the firearm, such as the "iron sights," can be used. In other instances, it may be desirable to remove the sight entirely. Accordingly, sight mounts have been provided with a hinge to provide the offsetting capability and with quick-detach features that allow the sight mounting device and sight to be removed quickly without tools.

Both offset mounts and quick-detach mounts should be precise and sturdy so that the sight can be mounted to the firearm without losing "zero" or the previously accomplished "sighting-in." On the other hand, such mounts should be easy and foolproof to operate with gloved hands or in conditions where manual dexterity is limited.

SUMMARY OF THE INVENTION

It is a general object of the present invention to provide an improved mounting apparatus for securing a sight device to a rail aligned with a sighting axis of a firearm. The mounting apparatus has both quick-detach and sight offset features, which may be provided together or separately.

This and other objects of the present invention are achieved by providing a sight mounting apparatus with a base having upper and lower extents, the upper extent of the base having a recess with generally opposing walls. A groove is formed in each of the generally opposing walls.

A sight base is configured to receive and secure the sighting device and is coupled to the base by a pin running in each of the grooves and rotatable about the pins between an aligned position with the base extending between the parallel walls and the optical device aligned with the sighting axis, and a deployed position rotated away from the aligned position. A detent mechanism extending between each of the walls and the sight base to releasably retain the sight base in the aligned position A clamp member is carried on the lower extent of the base, and is configured to releasably engage the rail with selectively movable to tighten and secure the clamp and base to the rail. A lever is pivotally coupled to the base and to the clamp member, the lever having a camming surface configured to move the movable portion of the clamp into and out of engagement with the rail in response to actuation of the lever. A resilient surface is carried by the base adjacent to the lever, wherein the camming surface of the lever bears on the resilient surface.

According to one embodiment of the invention, the sight base includes one-half a set of scope rings.

According to another embodiment of the invention, the rail is a picatinny rail.

According to yet another embodiment of the invention, the detent further includes a detent member configured to releasably secure the sight base in the aligned position.

Other objects, features, and advantages of the present invention will become apparent with reference to the drawings and the detailed description, which follow.

DETAILED DESCRIPTION OF THE INVENTION

Figure 1:
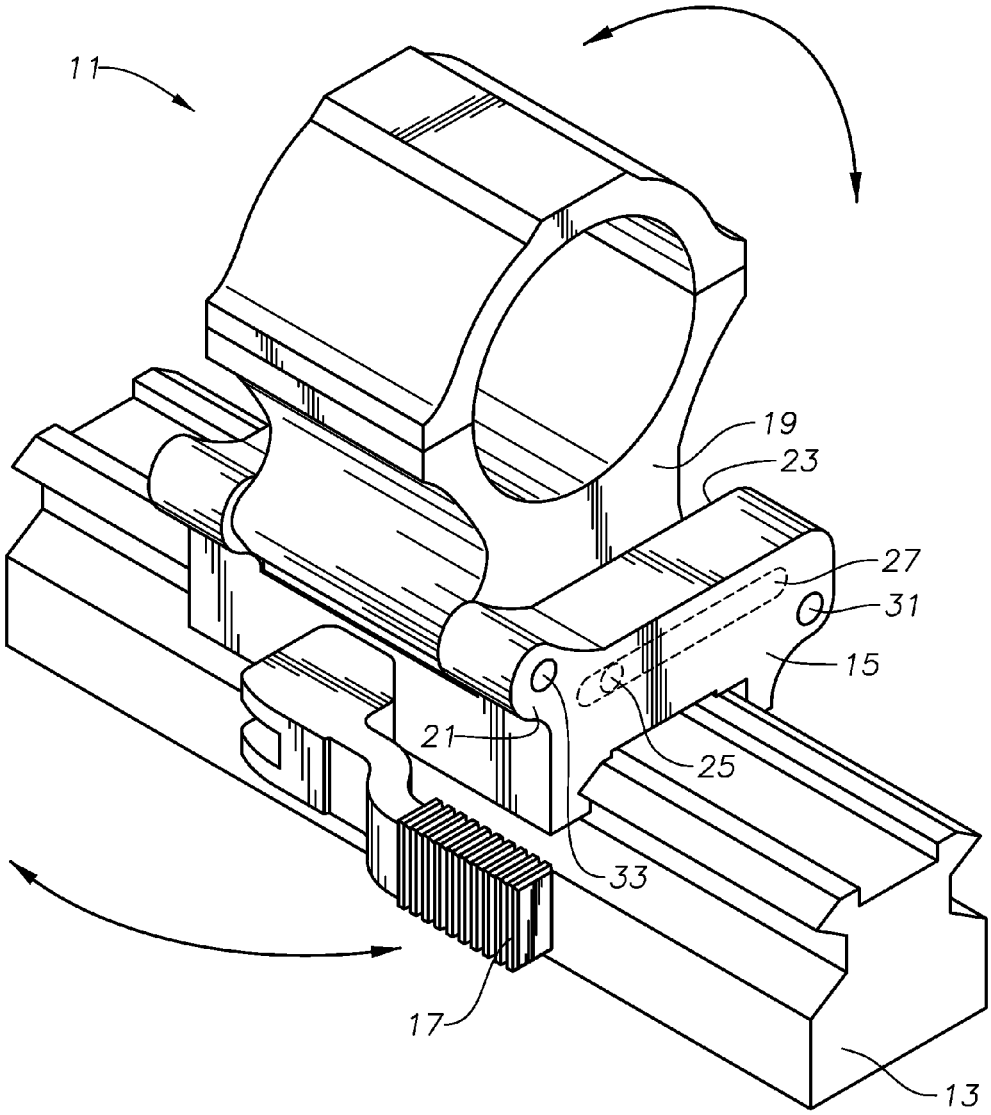
FIG. 1 is a perspective view of an embodiment of the sighting device mount according to the present invention.
Figure 2:
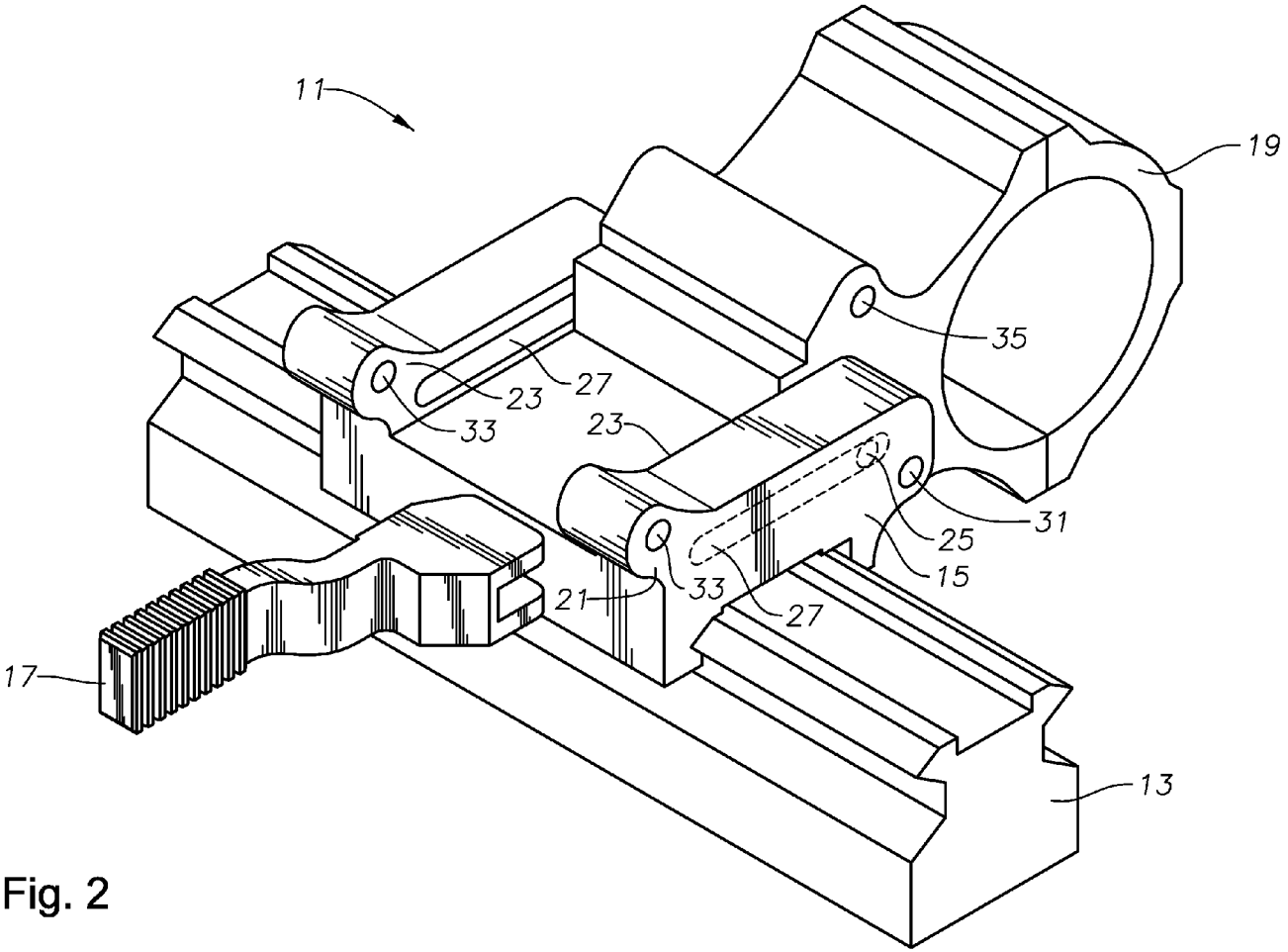
FIG. 2 is another perspective view of the sighting device mount of FIG. 1.

Referring now to the Figures, and particularly to FIGS. 1 and 2, a sight or sighting device mount 11 according to an exemplary embodiment of the present invention is shown. Mount 11 is secured to a rail 13 on a firearm (not shown). Rail 13 may be any of a number of conventional configurations including those known as "Weaver" or "Picatinny" rails that are commonly provided on firearms for mounting accessories to the weapon. The rail may be on a rifle, shotgun, or handgun, or even an archery bow (which falls into the definition of firearm for this purpose). Rail 13 is aligned with the sight axis, bore or sight line of the firearm so that anything mounted collinearly on it will also be aligned with the axis, subject to fine adjustment (commonly known as "sighting-in" or "zeroing" the weapon).

The sight or sighting device may comprise any of a number of well-known devices such as telescopic sights, laser sights, reflex, holographic or "red-dot" sights, infrared or other "night sights," or any other sight that may be used with a firearm and the type of mounting device described. Such a sighting device may even include a flashlight, which in this instance is a pointing-type of sighting device.

Sight mount 11 may comprise a base having a lower extent or clamp 15 for attachment to rail 13. Rails 13 commonly are of a dovetail cross-section to which mounting devices are attached by clamp arrangements that are typically secured by screws. In this case mount 11 has a "quick-detach" feature that is actuated by manipulating a lever 17. As described in greater detail in connection with FIG. 3, lever 17 is movable between open and closed position to selectively release a clamp that secures mount 11 to rail 13.

A sight base or sighting device attachment member 19 is secured to an upper extent 21 of the base. As shown, upper extent 21 of base is provided with a recess defined between a pair of opposing walls 23. A lower portion of a set of scope rings forming the sight base or sighting device attachment member 19 is disposed between walls 23. The sighting device attachment member is illustrated as conventional scope rings, but may take the form of any conventional means or arrangement for securing a sighting device to a mount.

The lower half of the scope rings 19 is provided with a pair of opposing pins 25 that ride in a pair of corresponding grooves 27 formed in each of the opposing walls 23, thus securing the lower half in the recess formed therebetween. The lower half of the rings then may both translate and rotate about pins 25 and move between an aligned position atop rail 15 (FIG. 1) and an offset position out of the sight line or axis of the firearm (FIG. 2).

As shown better in FIG. 2, the lower half of scope rings 19 is secured in the aligned and offset positions by a pair of spring-loaded ball detents 31, 33 carried on the upper extent 21 of the base. The ball members are received in a pair of corresponding recesses 35 formed in the lower half of scope rings 19. The ball detents thus secure the sight device attachment member in the aligned (detents 31, 35) and offset (33, 35) positions. The movement of sight device attachment 19 (and sighting device) relative to the base and rail 13 into and out of alignment with the sight axis of the weapon can be accomplished without manipulation of latches, switches or levers, while maintaining a rigid connection with the weapon that maintains the zero of the sight.

Figure 3:
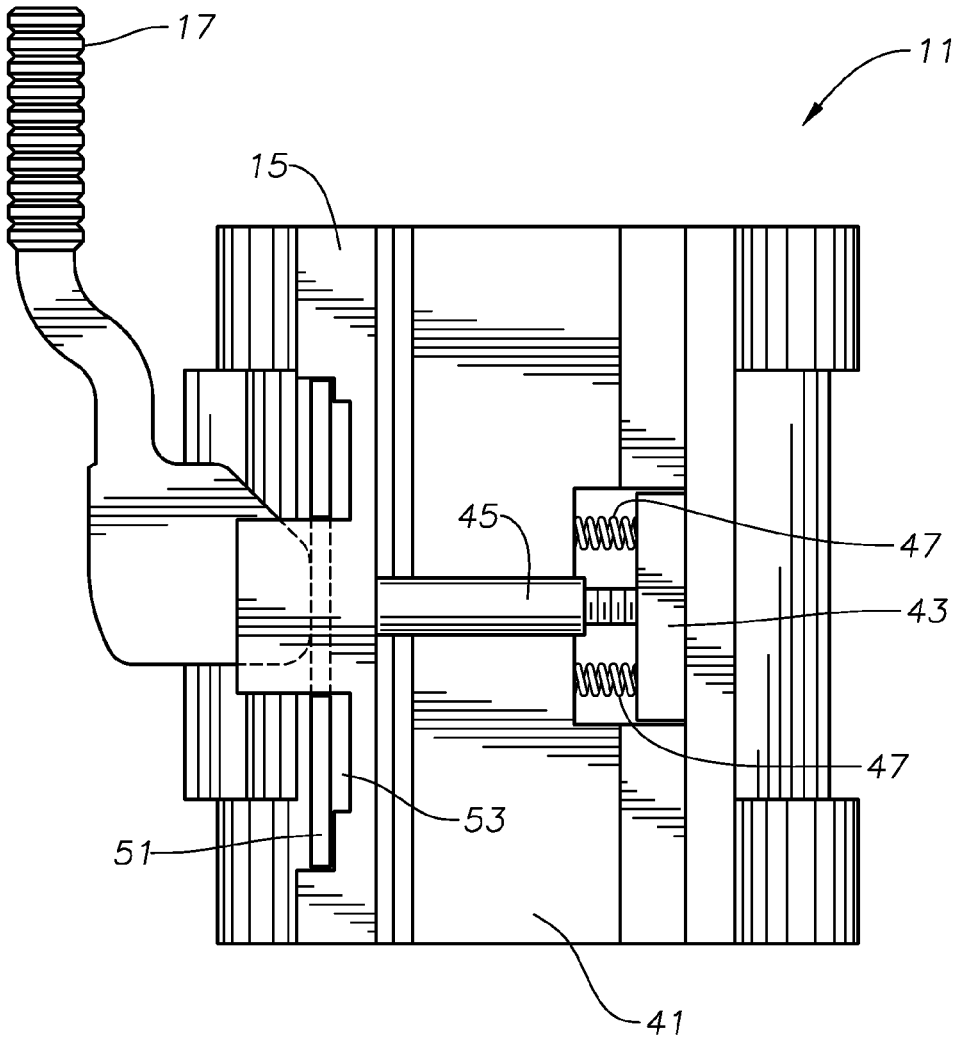
FIG. 3 is a bottom plan view of the sighting device mount of FIG. 1.

Turning now to FIG. 3, the construction of the quick-detach clamp is described in connection with a bottom plan view of lower extent 15 of the base of the sight mount 11. As depicted in FIGS. 1 and 2, rail 13 is received in a dovetail fashion in a recess 41 in lower extent 15 of the base of the mount of the invention. Mount 11 is secured and retained on rail 13 by a movable clamp member 43 which is moved into and out of engagement with rail 13 by actuation of lever 17. Lever 17 is connected to clamp 43 by a rod 45, which is threaded at its end to permit adjustment of the distance between lever 17 and clamp 43, and thus the amount of clamping force exerted (lever 17 is turned, thus lengthening or shortening rod 45). A pair of coil springs 47 are disposed between clamp 43 and the recess in which it slides to urge clamp 43 outward and to keep it from canting and assist positive engagement with the edge of rail 13.

To smooth the operation of lever 17, a flexible plate 51 is provided over a recess 53 and is secured at its ends to base 15. The camming surface of lever 17 (shown in phantom in FIG. 3) rides or bears on this plate 51, which deflects as the force increases, thereby smoothing the operation of lever 17. Flexible plate 51 thus defines a leaf spring or resilient biasing member that acts on (and is acted on by) the camming surface of lever 17.

In operation, a sighting device is attached to the sighting device attachment member 19. In the illustrative embodiment, a telescopic sight ("scope") or other tubular-bodied sight is affixed to mount by the rings 19. Lower extent 15 of the base is placed over rail 13 with lever 17 in the open position and movable clamp 43 biased outwardly by coil springs 47. When the mount 11 and sight are suitably positioned on rail 13, lever 17 is moved to the closed position, which draws clamp 43 inward to secure mount 11 on rail 13. The process may be reversed to remove mount 11 from rail 13.

If during operation of the weapon with mount 11, it is desireable to move the sighting device out of the way, upper extent 21 of sight device attachment member can be pushed from the aligned to the offset position, wherein the sighting device is offset from the sighting axis and another sighting device, for example the iron sights on a rifle, may be used. Ball detents 31, 33, 35 secure the sighting device in the aligned and offset positions with sufficient force to maintain zero (in the aligned position) and keep the sighting device secure (in the offset position) without requiring manipulation of latches and locks to accomplish the operation.

The invention has been described with reference to preferred and illustrative embodiments thereof. It is thus not limited, but is susceptible to variation and modification without departing from the scope and spirit of the invention as defined in the following claims.

The invention claimed is:

1. A mounting apparatus for securing a sight device to a rail aligned with a sighting axis of a firearm, the mounting apparatus comprising:

a base having upper and lower extents, the upper extent of the base having a recess with generally opposing walls;

a longitudinal groove in each of the generally opposing walls;

a sight base configured to receive and secure the sighting device, a portion of the sight base received between the opposing walls of and coupled to the base by a pair of pins, each pin running longitudinally in one of the grooves, the sight base rotatable about the pins between an aligned position with the sight base extending between the opposing walls and the sight device aligned with the sighting axis, and an offset position rotated away from the aligned position;

a detent mechanism extending between each of the walls and the sight base to releasably retain the sight base in the aligned position;

a clamp member carried on the lower extent of the base, the clamp configured to releasably engage the rail and having a portion selectively movable to tighten and secure the clamp and base to the rail;

a lever pivotally coupled to the base and to the clamp member, the lever having a camming surface configured to move the movable portion of the clamp into and out of engagement with the rail in response to actuation of the lever; and a resilient biasing member carried by the base adjacent to the lever, wherein the camming surface of the lever bears on the resilient member.

2. The mounting apparatus of claim 1, wherein the sight base includes one-half a set of scope rings.

3. The mounting apparatus of claim 1, wherein the rail is a picatinny rail.

4. The mounting apparatus of claim 1 further comprising a detent member configured to releasably secure the sight base in the offset position.

5. An apparatus for mounting a sighting device to a rail on a firearm in alignment with a sighting axis of the firearm, the apparatus comprising:

a base configured for removable attachment to the rail, the base having a recess with generally parallel, opposing walls;

a longitudinal groove in each of the generally parallel, opposing walls;

a sight base configured to receive and secure the sighting device, the sight base having a portion received between the parallel, opposing walls of and coupled to the base by a pin running longitudinally in each of the grooves and rotatable about the pins between an aligned position with the sight base extending between the parallel, opposing walls and the sighting device aligned with the sighting axis, and an offset position rotated away from the aligned position; and a detent mechanism extending between at least one of the walls and the sight base to releasably retain the sight base in the aligned position.

6. The mounting apparatus of claim 5, wherein the sight base includes one-half a set of scope rings.

7. The mounting apparatus of claim 5, wherein the rail is a picatinny rail.

8. The mounting apparatus of claim 5 further comprising a detent member configured to releasably secure the sight base in the offset position.

9. The apparatus of claim 1, wherein the resilient biasing member further comprises a plate overlying a recess in the base adjacent the camming surface of the lever and secured at each of its ends to the base, wherein the camming surface of the lever bears on the plate and the plate deflects in response to movement of the lever.

10. A mounting apparatus for securing a sight device to a rail aligned with a sighting axis of a firearm, the mounting apparatus comprising:

a base having upper and lower extents, the upper extent of the base having a recess with a pair of generally opposing walls;

a longitudinal groove in each of the generally opposing walls;

a sight base configured to receive and secure the sighting device, a portion of the sight base received between the opposing walls of and coupled to the base by a pair of pins, each pin running longitudinally in one of the grooves, the sight base rotatable about the pins between an aligned position with the sight base extending between the opposing walls and the sight device aligned with the sighting axis, and an offset position rotated away from the aligned position;

a detent mechanism extending between the base and the sight base to releasably retain the sight base in the aligned position;

a clamp member carried on the lower extent of the base, the clamp configured to releasably engage the rail and having a portion selectively movable to tighten and secure the clamp and base to the rail; and a lever pivotally coupled to the base and to the clamp member, the lever having a camming surface configured to move the movable portion of the clamp into and out of engagement with the rail in response to actuation of the lever.

11. The mounting apparatus of claim 10, wherein the sight base includes one-half a set of scope rings.

12. The mounting apparatus of claim 10, wherein the rail is a picatinny rail.

13. The mounting apparatus of claim 10, further comprising a detent member configured to releasably secure the sight base in the offset position.

14. The apparatus of claim 10, further comprising a plate overlying a recess in the base adjacent the camming surface of the lever and secured at each of its ends to the base, wherein the camming surface of the lever bears on the plate and the plate deflects in response to movement of the lever.

* * * * *